US005619890A

United States Patent [19]

Hattori et al.

[11] Patent Number: 5,619,890

[45] Date of Patent: Apr. 15, 1997

[54] SPANNER

[75] Inventors: Shinji Hattori, Tsuyama; Itsuro Kawamae, Mishima-gun; Yoshihiro Noguchi, Osaka, all of Japan

[73] Assignees: Tsubakimoto Emerson Co., Daito; Tsubakimoto Bulk Systems Corporation, Toyonaka, both of Japan

[21] Appl. No.: 513,636

[22] Filed: Aug. 10, 1995

[30] Foreign Application Priority Data

Aug. 10, 1994 [JP] Japan ..... 6-208193

[51] Int. Cl.[6] ..... B25B 13/00

[52] U.S. Cl. ..... 81/59.1; 81/60; 192/45

[58] Field of Search ..... 81/59.1, 60, 61; 192/44, 45

[56] References Cited

U.S. PATENT DOCUMENTS 4,408,504 10/1983 Dobosh ..... 81/59.1
4,939,961 7/1990 Lee ..... 81/60
5,461,950 10/1995 Iwinski ..... 81/61

FOREIGN PATENT DOCUMENTS 41-18627 8/1966 Japan .
43-24280 10/1968 Japan .
56-11076 7/1979 Japan .
7-24205 6/1995 Japan .

*Primary Examiner*—James G. Smith
*Attorney, Agent, or Firm*—Armstrong, Westerman Hattori, McLeland & Naughton

[57] ABSTRACT

A improved spanner includes a lever handle, coaxial interior and exterior rings, a plurality of columned cams with non-circular cross section retained in an annular space formed between both rings, an annular spring for rolling each columned cam on the outer peripheral surface of the interior ring and wedging the non-circular surface of each columned cam into the inner surface of the exterior ring, and a shaft, for mounting an adapter which engages a bolt head, nut, or the like, coaxially mounted in the interior ring. The shaft is movable in the direction of an axis of the interior ring.

2 Claims, 4 Drawing Sheets

SPANNER

FIELD OF THE INVENTION

The present invention relates generally to an improved spanner wherein the operational angle of helical movement for tightening or loosening a bolt, nut, or the like, is minimized.

BACKGROUND OF THE INVENTION

A conventional spanner which minimizes the operational angle of helical movement for tightening or loosening a bolt, nut, or the like, is disclosed in unexamined Japanese Utility Model Publication No. Hei 3-33066 (hereinafter referred to as 'the Japanese publication').

The spanner of the Japanese publication (not shown) includes the following: a lever handle; an exterior ring connected to an end of the lever handle; an interior ring coaxially disposed in the exterior ring; a plurality of columned cams each having a non-circular cross section which is retained at regular intervals in an annular space formed between an outer peripheral surface of the interior ring and an inner peripheral surface of the exterior ring; and an annular spring wherein the annular spring is mounted, urged to enlarging in diameter, in recess grooves each formed in the columned cam, such that each columned cam is rolled on the outer peripheral surface of the interior ring and wedged non-circular surface of each columned cam into the inner peripheral surface of the exterior ring.

However, the conventional spanner has problems when the space around a bolt head, nut, or the like is too narrow to insert the bolt, nut, etc. in an engaging bore of the interior ring, or when the rotational movement of the lever handle is difficult. In such cases, the helical movement by using the conventional spanner for tightening or loosening the bolt nut or the like is impossible

SUMMARY OF THE INVENTION

The above problems are solved by an improved spanner according to the present invention. The improved spanner includes: a lever handle; an exterior ring connected to an end of the lever handle; an interior ring coaxially disposed in the exterior ring; a plurality of columned cams with non-circular cross section retained at regular intervals in an annular space formed between an outer peripheral surface of the interior ring and an inner peripheral surface of the exterior ring; an annular spring for rolling each columned cam on the outer peripheral surface and wedging a non-circular surface of each columned cam into the inner peripheral surface, engaged in recess grooves each formed on the columned cam; and a shaft for connecting an adapter which engages a bolt head, nut, or the like, coaxially mounted in the interior ring, wherein the shaft is movable in a direction of an axis of the interior ring.

The improved spanner may be provided with a shaft positioning means which includes a ball equipped between the shaft and the interior ring and urged radially, and a positioning recess in which the ball is fitted.

The improved spanner may be provided with a shaft stopping means for preventing the shaft from being pulled off the ring.

The improved spanner may also be provided with a standard mark placed on one end of the interior ring, a life mark placed on one end of the interior ring and apart from the standard mark in the direction of movement of the lever for wedging the columned cams, and a wedging detection mark placed on one end of the exterior ring.

Further, the improved spanner may also be provided with an excessive external force protector at the free end of the lever handle.

According to the present invention, a shaft, for mounting an adapter which engages a bolt head, nut, or the like, at one end, is coaxially mounted in the interior ring. Therefore, by attaching the adapter to the shaft at an end thereof, a movement of the lever handle can be transmitted to the bolt, nut, or the like, by way of the adapter, if there is enough space for engaging a bolt head, nut, or the like, at an end of the adapter or even if there is not enough space for directly engaging the exterior ring with a bolt, nut, or the like, or receiving the lever handle around the bolt head, nut, or the like. Thus, tightening or loosening a bolt, nut, or the like, can be achieved by the improved spanner.

Further, the shaft is mounted in a space formed in the interior ring and is movable in the direction of an axis of the interior ring. Therefore, the shaft can take both positions such that one end off the shaft is protruding from one end of the interior ring, and the other end of the shaft is protruding from the other end of the interior ring. Thus, the improved spanner can be used without being turned over, even if a bolt head, nut, or the like, is located at either end of the interior ring.

In the case of an improved spanner having a standard mark, a life mark and a wedging detection mark, the interior ring will normally rotate according to the movement of the exterior ring with the wedging detection mark which is coincident with the standard mark by wedging the columned cams into the interior and exterior rings.

However, if the interior ring moves according to the movement of the exterior ring with the wedging detection mark coincident with the life mark by wedging the columned cams into the interior and exterior rings, it shows that the outer surface of the columned cams and/or the inner and outer surfaces of the exterior and interior rings was worn away. Thus, the life of the improved spanner can be shown by the relationship among those marks.

DETAILED DESCRIPTION OF THE PREFERRED EMBODIMENT

The preferred embodiment of an improved spanner according to the present invention, will now be described, in detail, with reference to the accompanying drawings.

Figure 1:
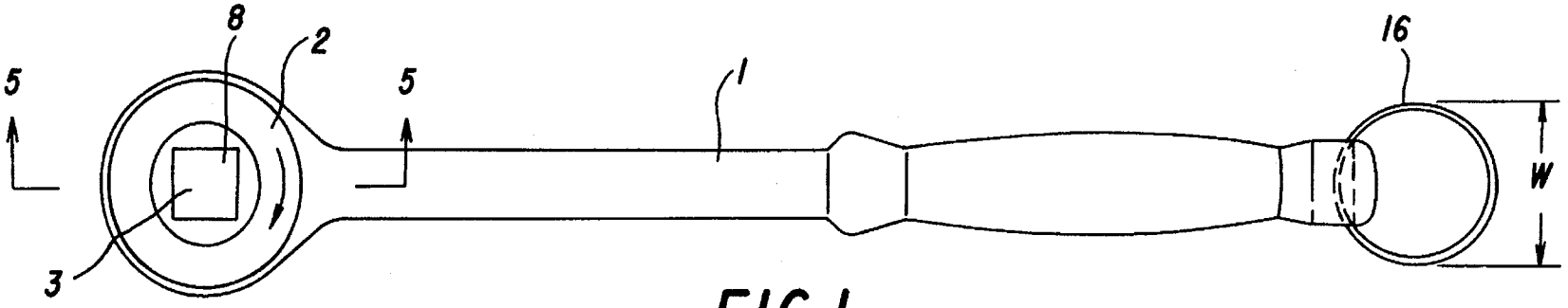
FIG. 1 shows a plan view of the improved spanner according to the present invention.
Figure 2:
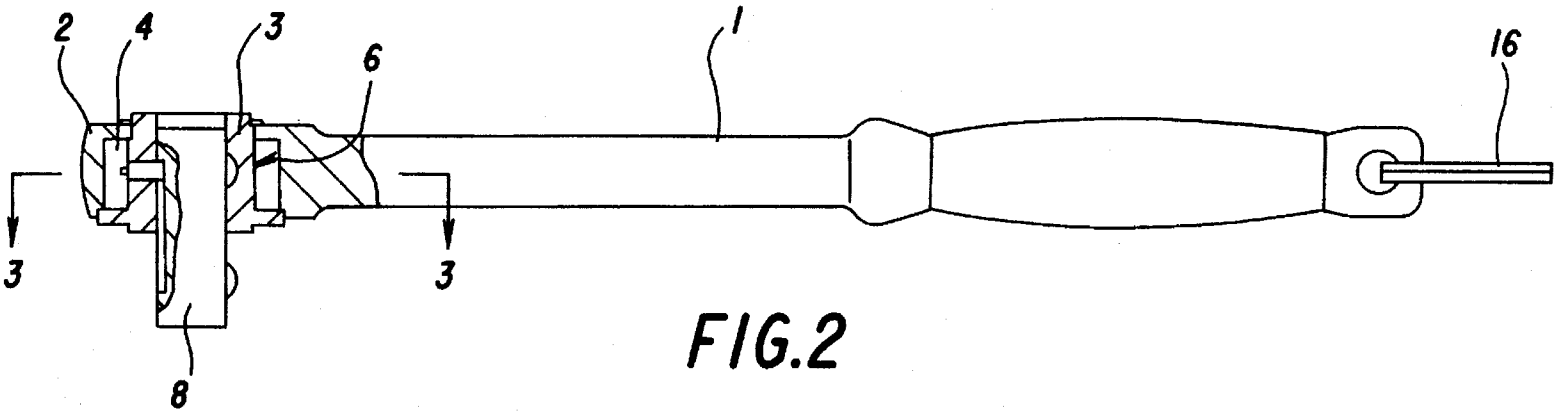
FIG. 2 shows a partially broken front view of the improved spanner shown in FIG. 1.
Figure 3:
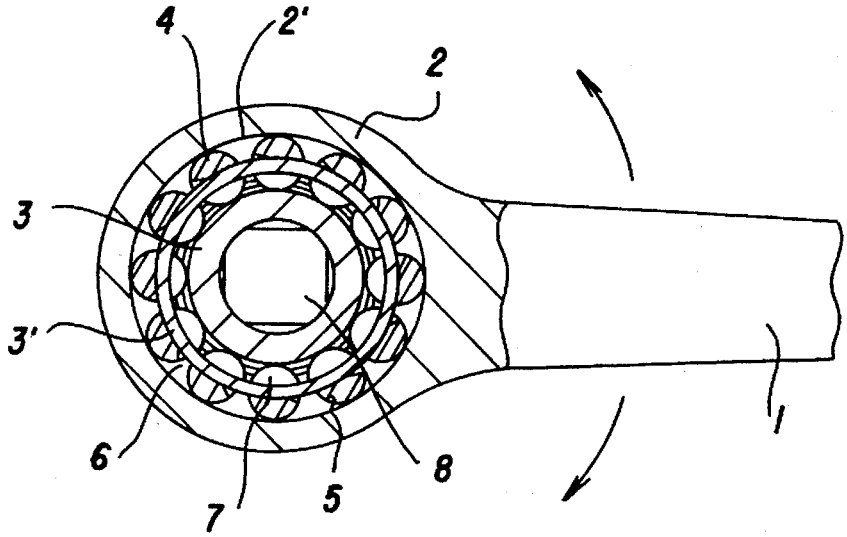
FIG. 3 shows an enlarged cross sectional view taken along the line 3—3 in FIG. 2.

As shown in FIGS. 1 and 2, the improved spanner includes a lever handle 1 having an exterior ring 2 at one end thereof and an interior ring 3 coaxially disposed in the exterior ring 2. As shown in Fig, 3, a plurality of columned canis 4 with non-circular cross section are retained by a retainer 5 at regular intervals in an annular space: formed between an inner peripheral surface 2' of the exterior ring 2 and an outer peripheral surface 3' of the interior ring 3. Each columned cam 4 has a recessed groove 7 The recessed groove 7 is formed by cutting out a section of the columed cam 4 and mounting an annular spring 6 in the recessed groove 7 and urging the annular spring 6 to enlarge in diometer to fit the recessed groove 7. A bottom surface of the recessed groove 7 is inclined such that the annular spring 6 urges each columned cam 4 to roll on the outer peripheral surface 3' of the interior ring 3 and to wedge the non-circular surface of the columned cam 4 into the inner surface 2' of the exterior ring 2.

Figure 4:
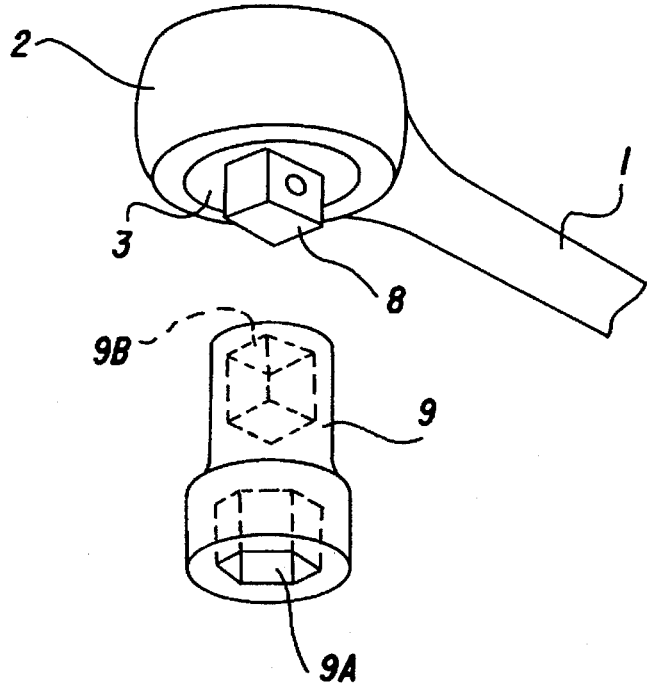
FIG. 4 shows a perspective view of one end of the improved spanner according to the present invention, in which an adapter is detached from the spanner.

A shaft 8 with rectangular cross section is inserted in the interior ring 3 in a manner such that the shaft 8 is movable the direction of an axis of the interior ring 3. Both ends of the shaft 8 fit to a socket portion 9B of an adapter 9, which adapter 9 is formed at one end thereof as shown in FIG. 4.

The adapter 9 has a cube-shaped recessed portion 9A at the other end thereof for engaging a bolt head, nut, or the like.

Figure 5:
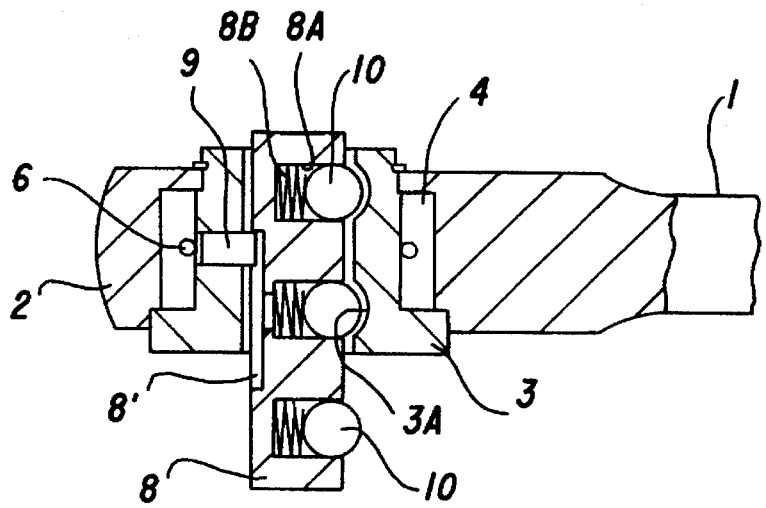
FIG. 5 shows an enlarged cross sectional view taken along the line 5—5 in FIG. 1.

FIG. 5 shows a shaft stopping member for preventing the shaft 8 from being pulled out of the interior ring 3 and a shaft positioning member for positioning the shaft 8 in the interior ring 3.

The shaft stopping member includes a longitudinal stopper guiding groove 8' formed on the surface of the shaft 8 and a stopper 9 fixed to the interior ring 3 and protruded from the inner peripheral surface 3' of the interior ring 3 to be guided along the groove 8'.

The shaft positioning member includes a positioning ball 10 fitted in a positioning bore 8A formed on the shaft 8 and urged outwardly by a spring 8B, and a positioning recess 3A formed on the inner peripheral surface 3' of the interior ring 3. Thus, the shaft 8 is positioned where the ball 10 is fitted in the positioning recess SA. In this embodiment, as shown in FIG. 5, the shaft 8 has three positioning balls 10 and the interior ring 3 has two positioning recess 3A.

Figure 6:
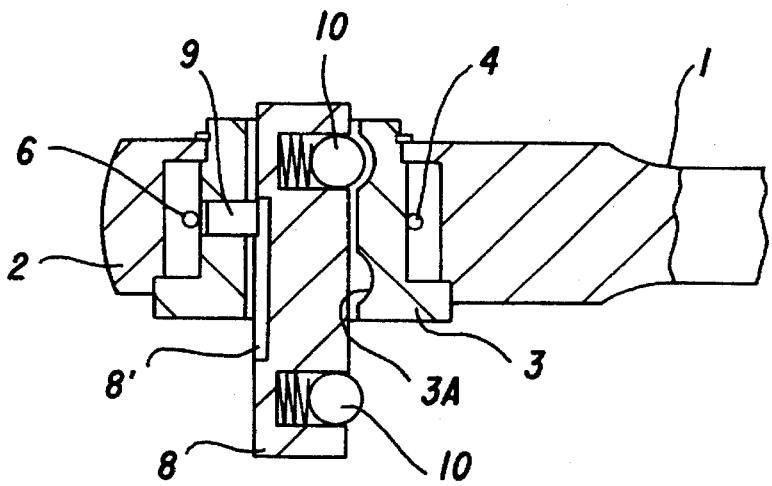
FIG. 6 shows an enlarged cross sectional view of a second embodiment of the improved spanner of the present invention, corresponding to FIG. 5.

Alternatively, the shaft positioning member may consist, for example, of two positioning balls 10 and two positioning recess 3A as seen in FIG. 6.

Figure 7:
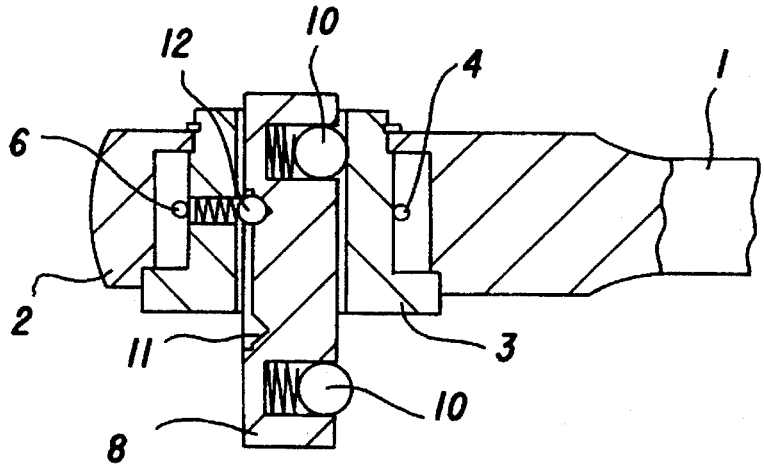
FIG. 7 shows an enlarged cross sectional view of a third embodiment of the improved spanner of the present invention, corresponding to FIG. 5.

FIG. 7 illustrates another embodiment of a combined shaft stopping and positioning member. The combined shaft Stopping and positioning member includes two V-shaped grooves 11 radially formed on the surface of the shaft 8 and a ball 12 urged inwardly and selectively engaged to one of the V-shaped grooves 11.

Figure 8:
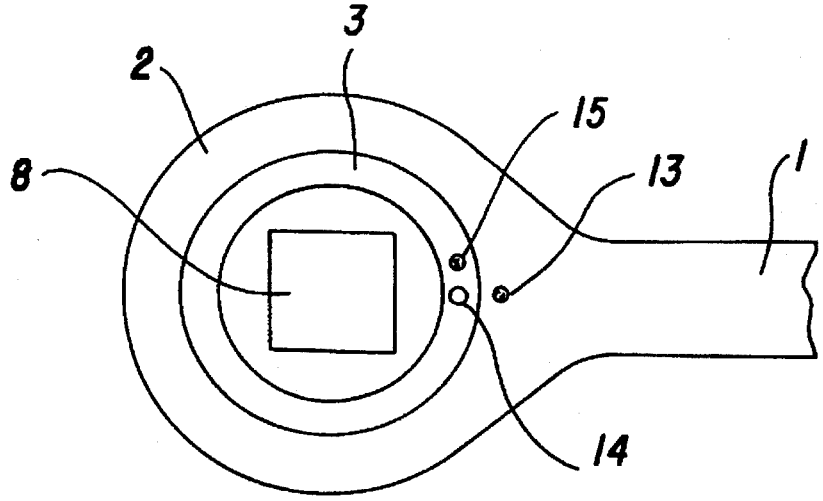
FIG. 8 shows an enlarged plan view of an end of the improved spanner according to the present invention, with a wedging detection mark coincident with a standard mark.
Figure 9:
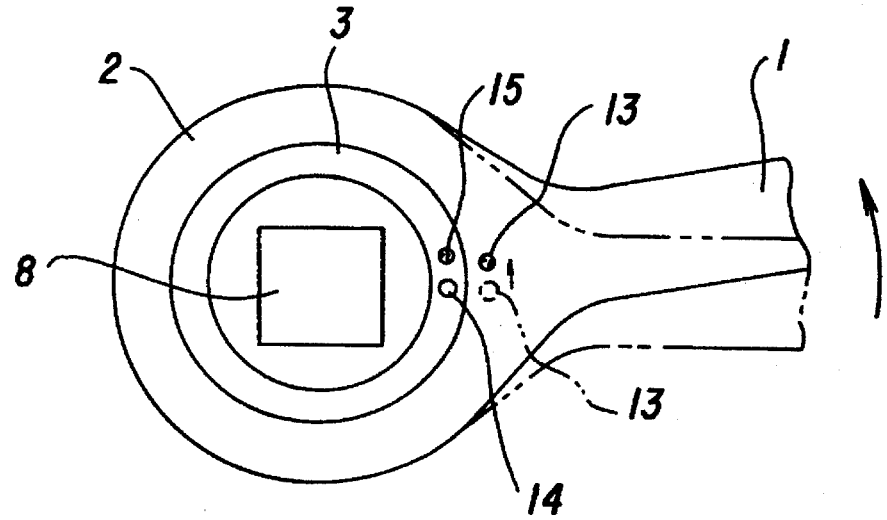
FIG. 9 shows an enlarged plan view of an end of the improved spanner according to the present invention, with a wedging detection mark coincident with a life mark.

As shown in FIG. 8 and FIG. 9, the improved spanner is provided with marks to detect the wear life of the cams 4, or in other words, the life of the improved spanner. The marks consist of a wedging detection mark 13 placed on one end of the exterior ring 2, a standard mark 4 placed on one end of the interior ring 3, and a life mark 15 placed on one end of the interior ring 3 and apart from the standard mark 14 in the direction of movement of the lever handle 1 for wedging the columned cams 4.

FIG. 8 illustrates the relationship among those marks when the improved spanner is still in the early stages of use. In the early stages of use, the interior ring 3 rotates according to the movement of the exterior ring 2 with the Wedging detection mark 13 coincident with the standard mark 15 by wedging the columned cams 4.

In such cases that the outer surface of the columned cams 4 and/or exterior and interior rings 2 and 3 is worn away, the lever handle 1 will change positions from the dashed line to solid line as shown in FIG. 9. If the interior ring 3 rotates according to the movement of the exterior ring 2 with the wedging detection mark 13 coincident with the life mark 15 , the relationship among those marks shows that the wear life of the improved spanner has come to an end.

As shown in FIGS. 1 and 2, the lever handle 1 is provided with an excessive external force protector 16 at a free end thereof. The protector 16 consists of a ring having a diameter larger than that of the lever handle 1. Alternatively, a rod, or the like, having a length which is longer than the length of the diameter of the lever handle 1 (not shown), may be used as an excess external force protector 16. Such a rod, or the like, should be positioned on the lever handle 1 such that the rod, or the like, makes a right angle with the lever handle 1. The excessive external force protector 16, such as a ring, rod, or the like, will prevent the lever handle 1 from being inserted by a pipe, or the like, to increase an external force of helical movement for tightening or loosening a bolt, nut, or the like. Thus, the improved spanner will be protected by the protector 16 from too excessive of a torque being applied. This is accomplished by the lengthening of the lever handle 1. The protector 16 can also be used as a hook for the improved spanner.

As will be understood from the foregoing, according to the improved spanner of the present invention, helical movement for tightening or loosening a bolt, nut, or the like will be achieved by a slight helical movement of the lever handle 1 because reciprocating movement of a lever handle 1 will achieve one way helical movement of a bolt, nut, or the like, by the cam clutch function of columned cams with non-circular cross section. Thus, the minimum operational angle of helical movement of the improved spanner can be further minimized.

Further, according to the improved spanner of the present invention, the shaft 8 is coaxially mounted in the interior ring 3 and movable in the direction of an axis of the interior ring 3. Therefore, by attaching the adapter 9 to the shaft 8 at one end thereof, the movement of the lever handle 1 can be transmitted to a bolt, nut, or the like, by way of the adapter 9, even if there is not enough space for directly engaging the exterior ring 2 with a bolt, nut, or the like, or receiving the lever handle 1 around the bolt head, nut, or the like. Thus, tightening or loosening a bolt, nut, or the like, can be achieved by the improved spanner.

Furthermore, the shaft 8 is movable in the direction of an axis of the interior ring 3. Therefore, the shaft 8 can take either one of two positions such that in one position one end of the shaft 8 is protruding from one end of the interior ring 3, and in the other position the other end of the shaft 8 is protruding from the other end of the interior ring 3. Thus, the improved spanner can be used without being turned over, even if a bolt head, nut, or the like, is located at either end of the interior ring 3.

In the case of an improved spanner having a standard mark 14, a life mark 15, and a wedging detection mark 13, wear of the cam mechanism cab be seen by the relationship among the marks. Thus, the wear life of the spanner can be known.

In an improved spanner providing an excessive external force protector 16 at free end thereof, an excessive torque to a bolt, nut, or the like, will be avoided. Therefore, loss of tightening or loosening function of a bolt, nut, or the like, caused by damage to screw thread, will be avoided.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A spanner, comprising:

a lever handle;

an exterior ring connected to an end of said lever hand;

an interior ring coaxially disposed in said exterior ring;

plurality of columned cams with non-circular cross section retained at regular intervals in an annular space formed between an outer peripheral surface of said interior ring and an inner peripheral surface of said exterior ring;

an annular spring, for rolling each columned cam on said outer peripheral surface and wedging a non-circular surface of each columned cam into said inner peripheral surface, engaged in recessed grooves each formed on said columned cam; and a shaft, for connecting an adapter which engages a bolt head, nut, or the like, coaxially mounted in said interior ring;

further comprising a standard mark placed on one end of said interior ring, a life mark placed on said one end of said interior ring but apart from said standard mark in a direction of movement of said lever for wedging said columned cams, and a wedging detection mark placed on said one end of said exterior ring.

2. A spanner, comprising:

a lever handle;

an exterior ring connected to an end of said lever hand;

an interior ring coaxially disposed in said exterior ring;

a plurality of columned cams with non-circular cross section retained at regular intervals in an annular space formed between an outer peripheral surface of said interior ring and an inner peripheral surface of said exterior ring;

an annular spring, for rolling each columned cam on said outer peripheral surface and wedging a non-circular surface of each columned cam into said inner peripheral surface, engaged in recessed grooves each formed on said columned cam; and a shaft, for connecting an adapter which engages a bolt head, nut, or the like, coaxially mounted in said interior ring;

further comprising an excess external force protector, wherein said protector is attached at a free end of said lever.

* * * * *